US010439317B2

(12) United States Patent
Horchler et al.

(10) Patent No.: US 10,439,317 B2
(45) Date of Patent: Oct. 8, 2019

(54) HERMETICALLY SEALED ELECTRICAL CONNECTOR ASSEMBLY

(71) Applicant: FCI USA LLC, Etters, PA (US)

(72) Inventors: David C. Horchler, Millersburg, PA (US); Robert E. Marshall, Elizabethtown, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 15/511,992

(22) PCT Filed: Sep. 10, 2015

(86) PCT No.: PCT/US2015/049288

§ 371 (c)(1),
(2) Date: Mar. 16, 2017

(87) PCT Pub. No.: WO2016/044042

PCT Pub. Date: Mar. 24, 2016

(65) Prior Publication Data

US 2017/0294737 A1 Oct. 12, 2017

Related U.S. Application Data

(60) Provisional application No. 62/052,280, filed on Sep. 18, 2014, provisional application No. 62/051,194, filed on Sep. 16, 2014.

(51) Int. Cl.
*H01R 4/48* (2006.01)
*H01R 13/52* (2006.01)
(Continued)

(52) U.S. Cl.
CPC ..... *H01R 13/5202* (2013.01); *H01R 12/71* (2013.01); *H01R 12/716* (2013.01);
(Continued)

(58) Field of Classification Search
CPC .. H01R 13/2442; H01R 23/722; H01R 12/57; H01R 23/725; H01R 9/0735; H01R 11/24
(Continued)

(56) References Cited

U.S. PATENT DOCUMENTS 6,358,063 B1 3/2002 Neidich
6,538,319 B2 * 3/2003 Terui ..... H01L 23/49811 257/691

(Continued)

FOREIGN PATENT DOCUMENTS

CN 1327710 A 12/2001
CN 1574466 A 2/2005

(Continued)

OTHER PUBLICATIONS

Taiwanese Office Action and English Translation for Taiwanese Application No. 104130658 dated Feb. 14, 2017.

(Continued)

*Primary Examiner* — Phuong Chi T Nguyen
(74) *Attorney, Agent, or Firm* — Wolf, Greenfield & Sacks, P.C.

(57) ABSTRACT

The interposer can include a substrate and first and second electrical connectors mounted to the substrate. The first electrical connector is configured to mate with a hard disk drive subassembly, and the second electrical connector is configured to mate with a flat flex circuit subassembly. The hard disk drive subassembly includes a hard disk drive case, a printed circuit board, and a third electrical connector mounted to the printed circuit board. The first and third electrical connectors are configured to mate with each other through the hard disk drive case so as to mate the interposer to the hard disk drive subassembly. The hard disk drive case can be hermetically sealed to the substrate of the interposer to prevent gas leakage

27 Claims, 14 Drawing Sheets

(51) Int. Cl.
*H01R 12/71* (2011.01)
*H01R 12/79* (2011.01)
*H01R 13/74* (2006.01)

(52) U.S. Cl.
CPC ..... *H01R 12/79* (2013.01); *H01R 13/521* (2013.01); *H01R 13/5205* (2013.01); *H01R 13/5216* (2013.01); *H01R 13/5219* (2013.01); *H01R 13/743* (2013.01); *H01R 13/74* (2013.01)

(58) Field of Classification Search
USPC ..... 439/862, 66, 83, 74, 67, 515
See application file for complete search history.

(56) References Cited

U.S. PATENT DOCUMENTS 6,633,078 B2 * 10/2003 Hamaguchi ..... H01L 23/13 257/686
8,059,364 B1 11/2011 Andrikowich et al.
2007/0032833 A1 2/2007 Gunderson
2013/0063838 A1 3/2013 Otake et al.

FOREIGN PATENT DOCUMENTS

EP 1162867 A1 12/2001
TW 2005/11669 A 3/2005
TW 2013/38655 A 9/2013
TW M468797 U 12/2013
WO WO 2014-061202 A1 4/2014

OTHER PUBLICATIONS

International Search Report and Written Opinion for International Application No. PCT/US2015/049288 dated Nov. 18, 2015.
International Preliminary Report on Patentability for International Application No. PCT/US2015/049288 dated Mar. 30, 2017.
Chinese Office Action for Chinese Application No. 201580059075.X dated Aug. 3, 2018.
Tian et al., High-Density Package Substrate. 2003;479-81.

* cited by examiner

HERMETICALLY SEALED ELECTRICAL CONNECTOR ASSEMBLY

RELATED APPLICATIONS

This application is the U.S. National Stage of and claims priority to and the benefit of International Patent Application No. PCT/US2015/049288, entitled "HERMETICALLY SEALED ELECTRICAL CONNECTOR ASSEMBLY," filed Sep. 10, 2015, which claims priority to and the benefit of U.S. Provisional Patent Application No. 62/052,280, filed Sep. 18, 2014, and U.S. Provisional Patent Application No. 62/051,194, filed Sep. 16, 2014. The entire contents of the foregoing are hereby incorporated herein by reference.

BACKGROUND

Hard-disk drives include magnetic-recording disks that spin and actuate head gimbal assemblies to access data stored on magnetic-recording disks at high speeds. In order to reduce load losses and related inefficiencies associated with the presence of air in the disk drive chamber, hermetically sealed chambers filled with a low density gas, such as helium, have become desirable.

SUMMARY

In accordance with one embodiment, an interposer can include a substrate that defines a first surface and a second surface opposite the first surface, electrical contact pads on each of the first and second surfaces, and vias that each extend through the substrate and electrically connect the electrical contact pads on the first surface with respective electrical contact pads on the second surface. The interposer can further include a seal member that at least partially surrounds the electrical contact pads on the first surface, and is configured to hermetically seal an interface between the first surface and a hard disk drive case of an electrical subassembly when the electrical subassembly is mated to the interposer.

BRIEF DESCRIPTION OF THE DRAWINGS

The foregoing summary, as well as the following detailed description of an example embodiment of the application, will be better understood when read in conjunction with the appended drawings, in which there is shown in the drawings an example embodiment for the purposes of illustration. It should be understood, however, that the application is not limited to the precise arrangements and instrumentalities shown. In the drawings.

DETAILED DESCRIPTION

Figure 1:
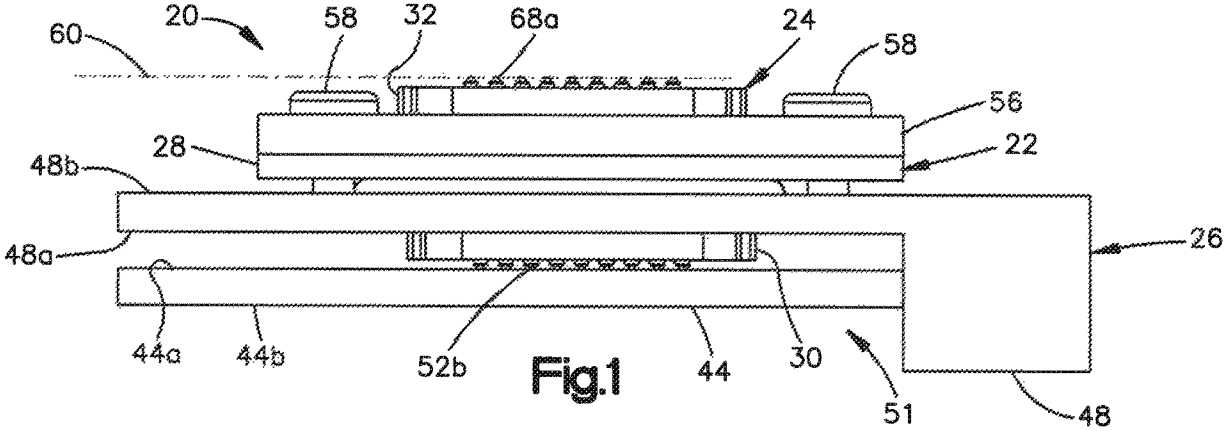
FIG. 1 is a side elevation view of an electrical connector assembly constructed in accordance with one embodiment.
Figure 2A:
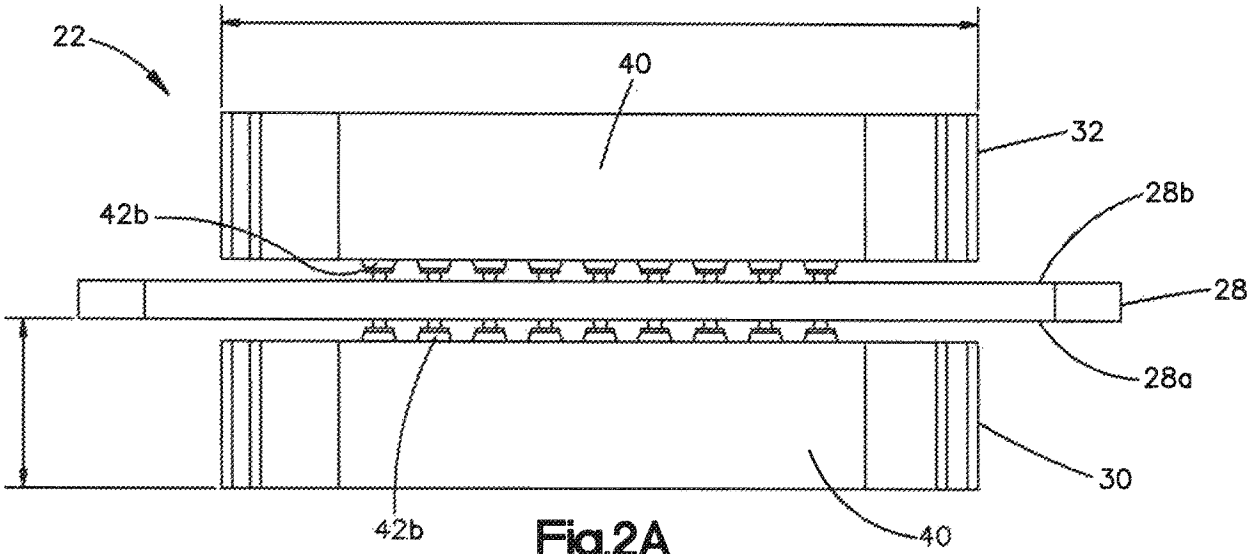
FIG. 2A is a side elevation view of an interposer of the electrical connector assembly illustrated in FIG. 1.
Figure 2B:
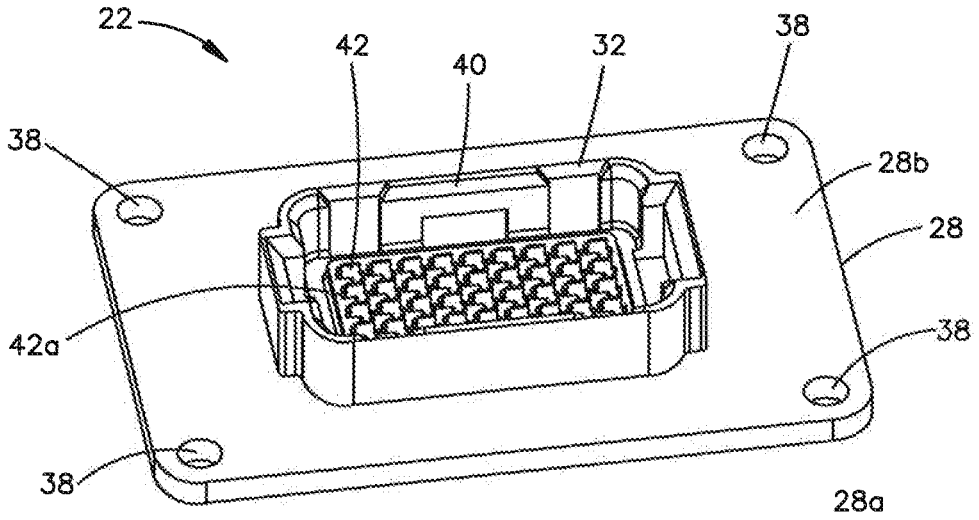
FIG. 2B is a perspective view of the interposer illustrated in FIG. 2A, showing an electrical connector mounted to a first surface of a printed circuit board.
Figure 2C:
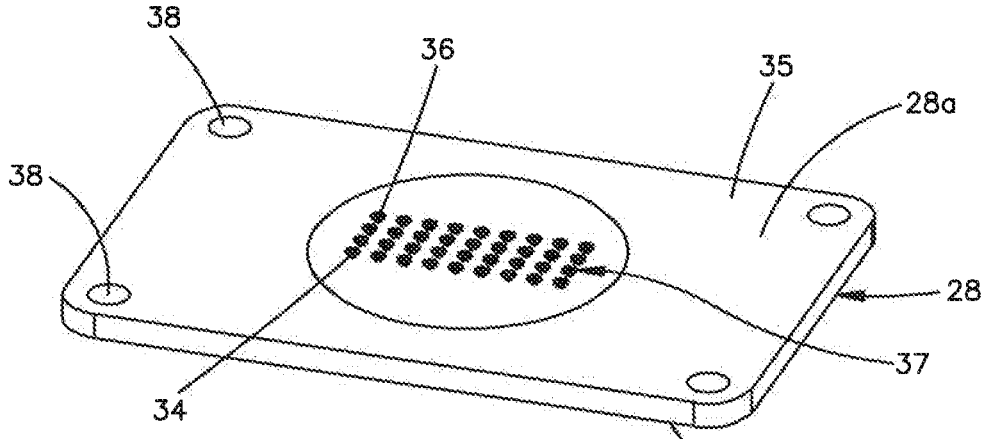
FIG. 2C is a perspective view of the printed circuit board, showing a second surface opposite the first surface.
Figure 2D:
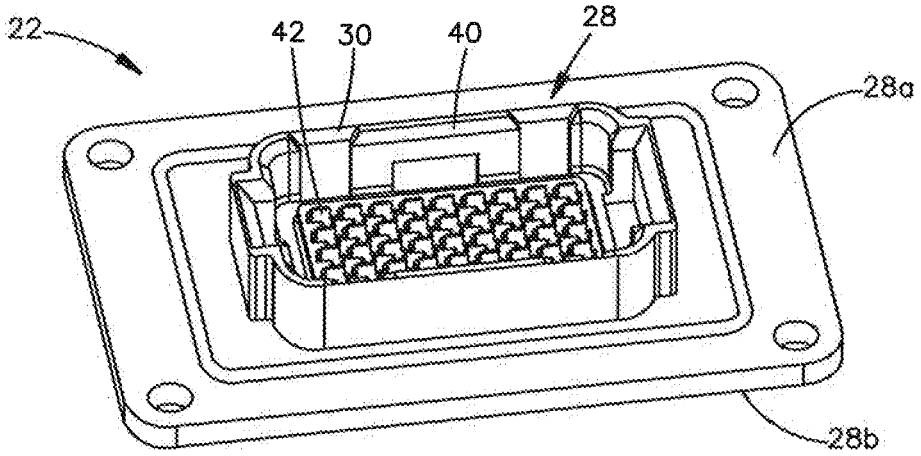
FIG. 2D is a perspective view of the interposer illustrated in FIG. 2A, showing a gasket applied to the second side of the printed circuit board.

Referring initially to FIG. 1, an electrical connector assembly 20 includes an interposer 22, a first electrical subassembly 24, and a second electrical subassembly 26. The interposer 22 is configured to establish an electrical connection between the first electrical subassembly 24 and the second electrical subassembly 26. The second electrical subassembly 26 can include a hard disk drive (HUD) case 48 that is hermetically sealed with the interposer 22 when the first electrical subassembly is mated with the interposer 22. The first electrical subassembly 24 can include a flat flex cable 60, and is configured to mate with the interposer 22 opposite the second electrical subassembly 26 thereby placing the flat flex cable 60 in electrical communication with a printed circuit of a substrate 44 of the second electrical subassembly 24 through the interposer 22.

Referring now to FIGS. 2A-2D, the interposer 22 includes a substrate 28 that defines first and second opposed surfaces 28*a* and 28*b*. The substrate 28 further includes a printed circuit. For instance, the substrate 28 can be configured as a flexible printed circuit, or alternatively as a printed circuit board (PCB) as described below (see FIG. 6). The interposer 22 further includes a first electrical connector 30 mounted to the first surface 28*a*, and a second electrical connector 32 mounted to the second surface 28*b*. The first and second electrical connectors 30 and 32 are placed in electrical communication with each other through the substrate 28. In one example, the substrate 28 can be a flexible printed circuit. For example, the substrate 28 can be made from a polyimide material. The polyimide material can be any suitable gas-impermeable polyimide material as desired. For instance, the polyimide material can be configured as a polyimide film. In one embodiment, the polyimide film can be made from Kapton® film, commercially available from DuPont®. The film can have any thickness as desired, such as between and including approximately 0.5 mm and 1.0 mm.

Thus, the substrate 28 can comprise the polyimide material. Alternatively or additionally, the substrate 28 can include bonded filament woven fiberglass sheets such as FR4 material. Alternatively or additionally still, the substrate 28 can include a liquid crystal polymer. For example, in one embodiment, the substrate 28 can include first and second layers of polyimide material, and FR4 material disposed between the first and second layers of polyimide material. Thus, the first and second layers of the polyimide material can define the first and second surfaces 28*a* and 28*b*, respectively. The FR4 material can be disposed between the first and second layers of polyimide material. Thus, the substrate 28 can be referred to as a laminate structure, having a layer of FR4 material disposed between adjacent layers of polyimide. The FR4 material can be gas impermeable. For instance, the FR4 material can be hydrogen or helium impermeable. It should also be appreciated that the substrate 28 can include as many interleaved layers of FR4 material and polyimide material as desired.

As described above, the substrate 28 can alternatively or additionally include any suitable liquid crystal polymer (LCP) material as desired. The LCP material can be gas impermeable. For instance, the LCP material can be hydrogen or helium impermeable. In one example, the LCP material can be Rogers 3850 Ultralam® laminate material, commercially available from Rogers Corporation, having a place of business in Rogers, Conn. For example, in one embodiment, the substrate 28 can include first and second layers of LCP material, and FR4 material disposed between the first and second layers of LCP material. Thus, the first and second layers of the LCP material can define the first and second surfaces 28*a* and 28*b*, respectively. The FR4 material can be disposed between the first and second layers of LCP material. Thus, the substrate 28 can be referred to as a laminate structure, having a layer of FR4 material disposed between adjacent layers of LCP. It should also be appreciated that the substrate 28 can include as many interleaved layers of FR4 material and LCP material as desired.

It should further be appreciated that the substrate 28 can include one or more layers of LCP material, one or more layers of FR4 material, and one or more layers of polyimide material, as desired.

In one example, the substrate 28 can include a layer 35 of a metal that is applied to the first surface 28*a*. The layer 35 can be a layer of silver. The substrate 28 can further include a plurality of apertures 38 that extend there through from the first surface 28*a* to the second surface 28*b*. The apertures 38 are sized to receive fasteners that secure the interposer to the first electrical subassembly 24 as described in more detail below.

The substrate 28 can further include electrical contact pads 34 at each of the first and second surfaces 28*a* and 28*b*. The substrate 28 can include electrically conductive vias 36 that are in electrical communication with respective ones of the contact pads 34 at the first surface 28*a* and complementary ones of the contact pads 34 at the second surface 28*b*. Thus, the vias 36 place respective ones of the contact pads 34 at the first surface 28*a* to complementary ones of the contact pads 34 at the second surface 28*b*. Accordingly, electrical contacts that are mounted to respective contact pads 34 at one of the first and second surfaces 28*a* and 28*b* is in electrical communication with the complementary contact pads 34 at the other of the first and second surfaces 28*a* and 28*b*.

The vias 36 can be plated with an electrically conductive material. Alternatively or additionally, the vias 36 can be filled, for instance, with an electrically conductive material, that hermetically seals the vias 36 with respect to the interior 51 of the hard disk drive case 48. The contact pads 34 at the first surface 28*a* can be offset along the first surface 28*a* from the respective vias 36 with which they are in electrical communication. Thus, the contact pads 34 of the first surface 28*a* can be offset from the vias 36 along the first surface 28*a*. The substrate 28 can define electrically conductive traces 38 that electrically connect each of the contact pads 34 of the first surface 28*a* to a corresponding one of the vias 36. The electrically conductive traces 38 can extend along the first surface 28*a*. Similarly, the contact pads 34 at the second surface 28*b* can be offset along the second surface 28*b* from the respective vias 36 with which they are in electrical communication. Thus, the contact pads 34 of the second surface 28*b* can be offset from the vias 36 along the second surface 28*b*. The substrate 28 can define electrically conductive traces 38 that electrically connect each of the contact pads 34 of the second surface 28*b* to a corresponding one of the vias 36. The electrically conductive traces 38 can extend along the second surface 28*b*. The substrate 28 can define a region 37 that contains all vias 36 and contact pads 34 that are configured to be placed in electrical communication with the first and second subassemblies 24 and 26. The region 37 can be surrounded by the layer 35. If offset contact pads are to be used care needs to be taken to ensure that the vias are sealed. In such a situation, a via filler such as reflowed solder or a non-conductive epoxy could be utilized.

The first and second electrical connectors 30 and 32 can be constructed in accordance with any manner desired. In general, each of the electrical connectors 30 and 32 includes a connector housing 40, and a plurality of electrical contacts 42 that are supported by the connector housing 40. The electrical connectors 30 and 32 can include any number of rows and columns of electrical contacts 42 as desired. The electrical contacts 42 can be constructed generally as described in U.S. Pat. No. 6,042,389, or US Published Patent Application No. 2014/0017957, the disclosure of each of which is hereby incorporated by reference as if set forth in its entirety herein. The electrical contacts 42 can include signal contacts and ground contacts. Adjacent ones of the signal contacts can define differential signal pairs, and adjacent differential signal pairs can be separated by at least one ground contact. The differential signal pairs can be edge coupled or broadside coupled pairs as desired. Thus, each of the electrical contacts 42 can define a mating end 42*a* and a mounting end 42*b*. The mounting ends 42*b* can be surface mounted to respective ones of the contact pads 34. Thus, the electrical contacts 42 can be referred to as surface mount contacts, and the electrical connectors 30 and 32 can be referred to as surface mount connectors. For instance, the electrical contacts 42 can support a fusible element, such as a solder ball, at the mounting ends 42*b*. The solder balls can all be co-planar with each other both before and after the solder reflow process is completed that bonds the fusible elements to respective ones of the contact pads 34, thereby mounting the electrical connectors 30 and 32 to the substrate 28. The solder balls can be mounted to the contact pads 34 by positioning the first and second electrical connectors 30 and 32 on the first and second surfaces 28*a* and 28*b*, respectively, and subjecting the electrical connectors 30 and 32 and the substrate 28 to a solder reflow process whereby the solder balls fuse to the contact pads 34. The solder balls can be integral and monolithic with the electrical contacts 42, or can be separate and attached to the mounting ends 42*b*. Alternatively, the mounting ends 42*b* can be configured as J-shaped leads that are compressed against the contact pads 34 so as to mount one or both of the electrical connectors 30 and 32 to the substrate 28. Alternatively still, the mounting ends 42*b* can be configured as press-fit tails that are inserted into the vias 36 so as to mount one or both of the electrical connectors 30 and 32 to the substrate 28. If press fit tails are used, care would need to be taken to ensure that the vias into which the press fit tails are inserted are sealed. In such a situation, so-called blind holes could be used or a via filler such as reflowed solder or a non-conductive epoxy. In one embodiment, the first and second electrical connectors 30 and 32 are identical to each other.

Mating ends 42*a* can be configured as plug mating ends. Alternatively, the mating ends 42*a* can be configured as receptacle mating ends. In accordance with one embodiment, the mating ends 42*a* of each of the first and second electrical connectors 30 and 32 are configured as plugs. Alternatively, the mating ends 42*a* of each of the first and second electrical connectors 30 and 32 can be configured as receptacle mating ends. Alternatively still, the mating ends 42*a* of one of the first and second electrical connectors 30 and 32 can be plugs, and the mating ends 42*a* of one of the first and second electrical connectors 30 and 32 can be receptacles. In one example, the mating ends 42*a* and the mounting ends 42*b* are oriented parallel to each other, such that the electrical contacts 42 can be referred to as vertical contacts. In another embodiment, the mating ends 42*a* and the mounting ends 42*b* can be oriented perpendicular to each other, such that the electrical contacts 42 can be referred to as right-angle contacts.

Referring now to FIGS. 3A-3F, the second electrical subassembly 26 is configured to mate with the first electrical connector 30, so as to be placed in electrical communication with the first electrical connector 30. Thus, the second electrical subassembly 26 is configured to mate with the first electrical connector 30, so as to be placed in electrical communication with the second electrical connector 32 through the first electrical connector 30. The second electrical subassembly 26 includes a substrate 44, and a corresponding electrical connector 46 mounted to the substrate 44. The substrate 44 further includes a printed circuit. For instance, the substrate 44 can be configured as a printed circuit board (PCB). Thus, the second electrical subassembly 26 can be referred to as a PCB subassembly. The substrate 44 can define a first surface 44*a* and a second surface 44*b* opposite the first surface. The electrical connector 46 of the second electrical subassembly 26 can be referred to as a third electrical connector.

The third electrical connector 46 is configured to mate with the first electrical connector 30. For instance, the third electrical connector 46 includes a connector housing 63, and a plurality of electrical contacts 50 that are supported by the connector housing 63. The connector housing 63 can be received by the connector housing 40 of the first electrical connector 30 when the first and third electrical connectors 30 and 46 are mated to each other. Alternatively, the connector housing 63 can receive the connector housing 40 of the first electrical connector 30 when the first and third electrical connectors 30 and 46 are mated to each other. The electrical connector 46 can include any number of rows and columns of electrical contacts 50 as desired. For instance, the third electrical connector 46 can include the same number of rows and columns as the first electrical connector 30, such that each of the electrical contacts 50 of the third electrical connector 46 are configured to mate with respective ones of the electrical contacts 50 of the first electrical connector 30. The electrical contacts 50 can be constructed generally as described in U.S. Pat. No. 6,042,389, or US Published Patent Application No. 2014/0017957, the disclosure of each of which is hereby incorporated by reference as if set forth in its entirety herein. The electrical contacts 50 can include signal contacts and ground contacts. Adjacent ones of the signal contacts can define differential signal pairs, and adjacent differential signal pairs can be separated by at least one ground contact. The differential signal pairs can be edge coupled or broadside coupled pairs as desired.

Thus, each of the electrical contacts 50 can define a mating end 52*a* and a mounting end 52*b*. The mounting ends 52*b* can be surface mounted to the first surface 44*a* of the substrate 44 so as to be placed in electrical communication with the printed circuit carried by the substrate. Thus, the electrical contacts 50 can be referred to as surface mount contacts, and the third electrical connector 46 can be referred to as a surface mount connector. For instance, the electrical contacts 50 can support a fusible element, such as a solder ball, at the mounting ends 52*b*. The solder balls can all be co-planar with each other both before and after the solder reflow process is completed that bonds the fusible elements to respective contact pads of the substrate 44, thereby mounting the third electrical connector 46 to the substrate 44. The solder balls can be mounted to the contact pads by positioning the first third electrical connector 46 on the substrate 44, and subjecting the third electrical connector 46 and the substrate 44 to a solder reflow process whereby the solder balls fuse to the contact pads of the substrate 44. The solder balls can be integral and monolithic with the electrical contacts 50, or can be separate and attached to the mounting ends 52*b*. Alternatively, the mounting ends 52*b* can be configured as J-shaped leads that are compressed against the contact pads so as to mount the third electrical connector 46 to the substrate 44. Alternatively still, the mounting ends 52*b* can be configured as press-fit tails that are inserted into vias of the substrate 44 so as to mount the third electrical connector 46 to the substrate 44.

The mating ends 52*a* can be configured as receptacle mating ends that are configured to receive the plug mating ends 42*a* of the first electrical connector 30 so as to mate the first and third electrical connectors 30 and 46 to each other. Alternatively, the mating ends 52*a* can be configured as plug mating ends that are configured to be received by the mating ends 42 of the first electrical connector 30, which can be configured as receptacle mating ends. Alternatively still, the mating ends 42*a* and 52*a* can both be configured as receptacle beams that are configured to mate with each other. In one example, the mating ends 52*a* and the mounting ends 52*b* are oriented parallel to each other, such that the electrical contacts 50 can be referred to as vertical contacts. In another embodiment, the mating ends 52*a* and the mounting ends 52*b* can be oriented perpendicular to each other, such that the electrical contacts 50 can be referred to as right-angle contacts.

The second electrical subassembly 26 can further include a case 48, such as a hard disk drive (HDD) case. The case 48 defines a first surface 48*a* and a second surface 48*b* opposite the first surface 48*a*. The first surface 48*a* can at least partially or entirely define an interior 51 that is configured to contain a plurality of hard disk drives. The case 48 can further define an aperture 49 that extends there through from the first surface 48*a* to the second surface 48*b*. The aperture 49 can be defined by a perimeter that is continuous and enclosed by the case 48. The case 48 can be positioned such that one or both of the first and third electrical connectors 30 and 46 extends through the aperture 49 so as to mate with each other. The substrate 44 can be disposed adjacent the first surface 48*a* of the case 48, such that the third electrical connector 46 extends from the substrate 44 through the aperture 49. Alternatively, the third electrical connector 46 can be recessed from the aperture 49 and wholly contained in the interior 51. Accordingly, the first surface 44*a* of the substrate faces the first surface 48*a* of the case 48. The third electrical connector 46 is configured to mate with the first electrical connector 30, thereby placing the substrate 44 in electrical communication with the interposer 22. For instance, the first electrical connector 30 can be inserted through the aperture 49 so as to mate with the third electrical connector 46. Alternatively, the third electrical connector 46 can extend from the substrate 44 through the aperture 49, or can terminate within the aperture 49. The substrate 44 is disposed in the interior 51, along with the hard disk drives that are in electrical communication with the substrate 44. Thus, the hard disc drives are placed in electrical communication with the interposer 22 when the first electrical subassembly 24 is mated to the interposer 22. The outer periphery of the substrate 44 can further extend into a pocket 55 of the case 48 that extends into a periphery of the case 48 within the interior 51.

The case 48 and the substrate 28 of the interposer 22 are configured to interface with each other when the first and third electrical connectors 30 and 46 are mated with each other. The interface of the case 48 and the substrate 28 is configured to hermetically seal the interior 51 with respect to gaseous leakage from inside the interior 51 to a location outside the interior when the first electrical subassembly 24 is mated to the interposer 22. In one embodiment, the gas can be helium or hydrogen. Alternatively, the gas can be any other suitable gas as desired. In particular, the second surface 48*b* of the case 48 can be hermetically sealed with the interposer 22, and in particular the substrate 28. For instance, the electrical connector assembly 20 can include a seal member 54 at the interface of the case 48 and the substrate 28. In particular, the interface can be defined between the first surface 44*a* of the substrate 44 and the second surface 48*b* of the case 48.

Figure 3A:
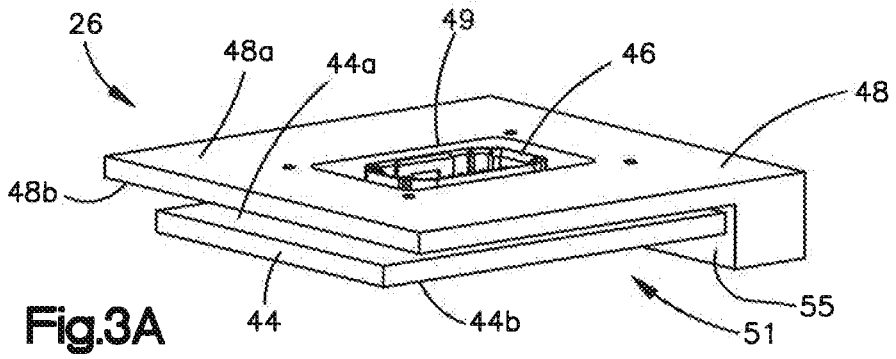
FIG. 3A is a perspective view of a portion of a PCB subassembly configured to be mated to the interposer illustrated in FIG. 2A.
Figure 3B:
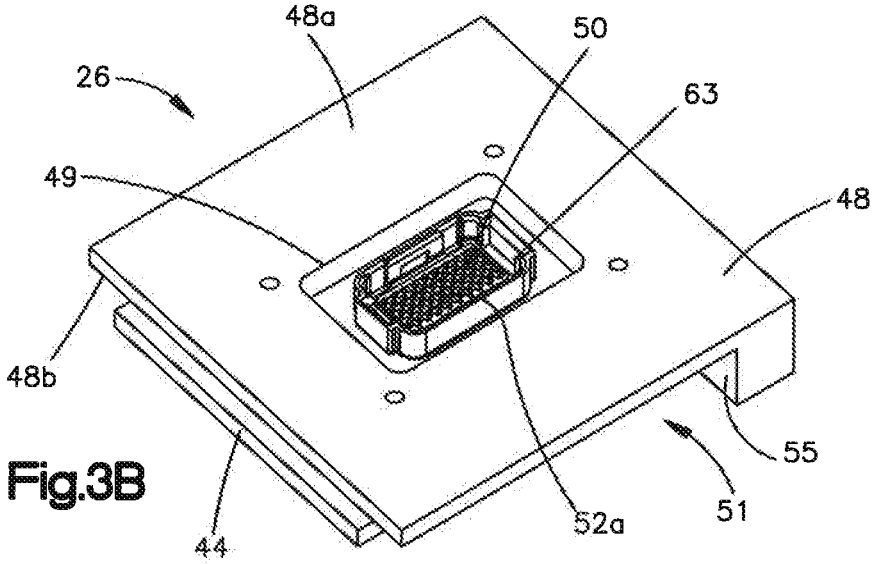
FIG. 3B is another perspective view of the portion of the PCB subassembly illustrated in FIG. 3A.
Figure 3C:
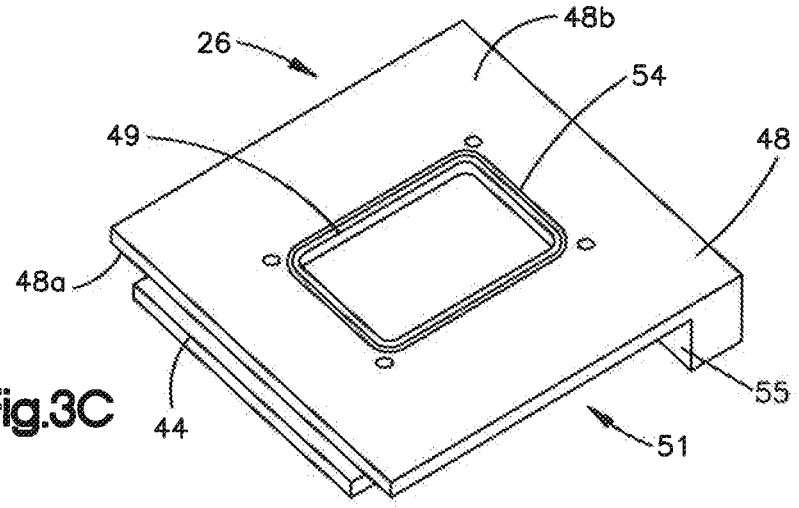
FIG. 3C is a perspective view of the portion of the PCB subassembly illustrated in FIG. 3A, but including a gasket applied to a mating surface of a hard disk drive case.
Figure 4:
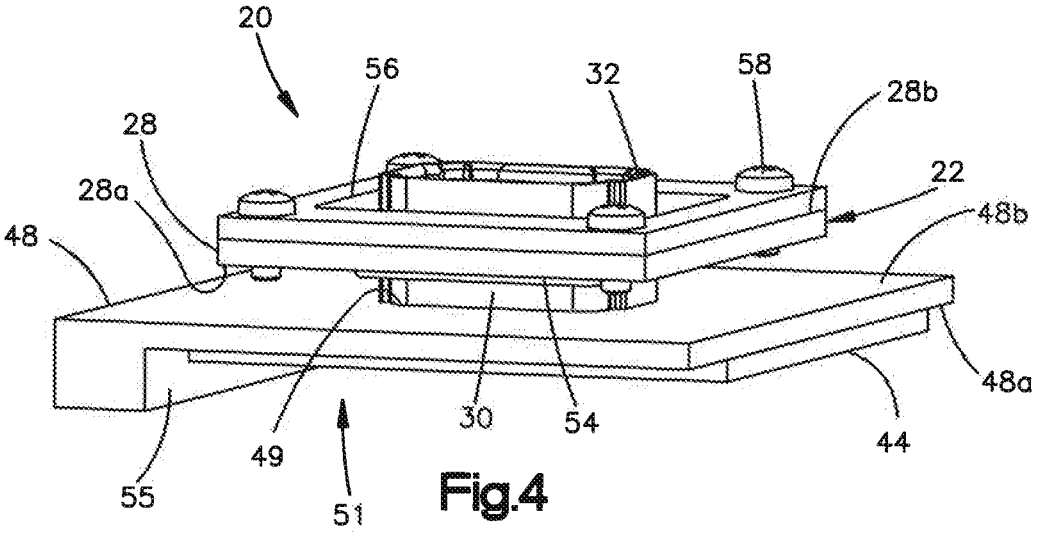
FIG. 4 is a perspective view showing the interposer mated with the PCB subassembly in accordance with an alternative embodiment.

The seal member 54 can be carried by the second surface 48*b* of the case 48 or the first surface 28*a* of the substrate 28. As illustrated in FIG. 3C, the seal member 54 is carried by the second surface 48*b* of the case 48. As illustrated in FIG. 4, the seal member 54 is carried by the first surface 28*a* of the substrate 28. Either way, once the first electrical subassembly 24 has been mated to the interposer, the seal member 54 at least partially surrounds the electrical contact pads 34 on the first surface 28*a* of the substrate 28 (and corresponding vias 36). For instance, the seal member 54 can completely circumscribe the electrical contact pads 34 on the first surface 28*a* (and the corresponding vias 36). Thus, the interposer 22 can be said to include the seal member 54 regardless of whether the seal member 54 is carried by the substrate 28 prior to mating with the first electrical subassembly 24, or after mating with the first electrical subassembly 24. Once the third electrical connector 46 is mated with the first electrical connector 30, the seal member 54 is disposed between the case 48 and the substrate 28. For instance, the seal member is disposed between the second surface 48*b* of the case 48 and the first surface 28 of the substrate 28. In one example, the seal member 54 is in contact with both the case 48 and the substrate 28 at the interface between the case 48 and the substrate 28. As described above, the interface is defined by the second surface 48*b* of the case 48 and the first surface 28*a* of the substrate 28.

Figure 3D:
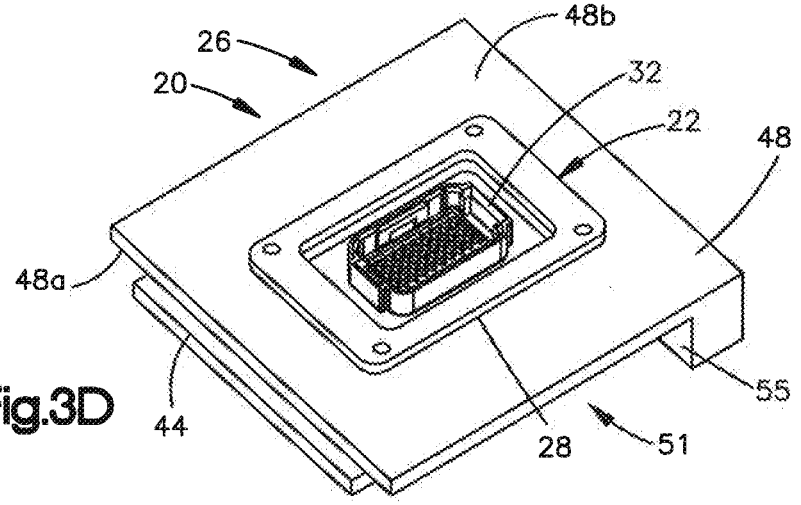
FIG. 3D is a perspective view showing an assembly including the interposer of FIG. 2A mated to the PCB subassembly illustrated in FIG. 3C.
Figure 3E:
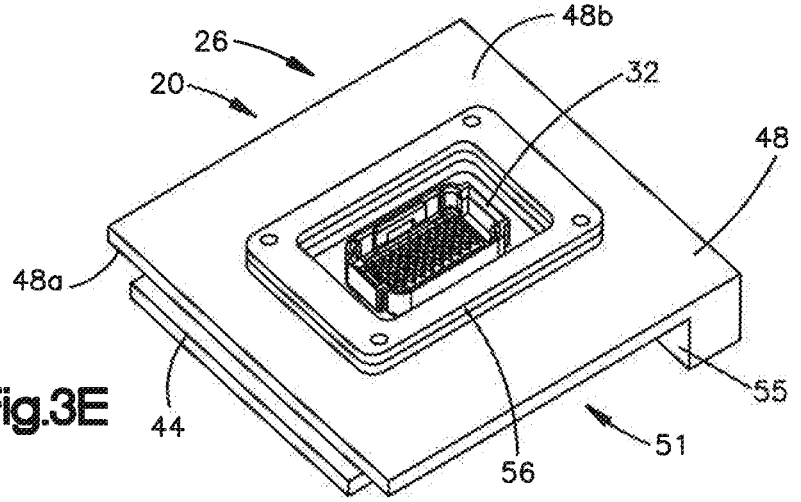
FIG. 3E is a perspective view of the assembly illustrated in FIG. 3D, but including a stiffener.
Figure 3F:
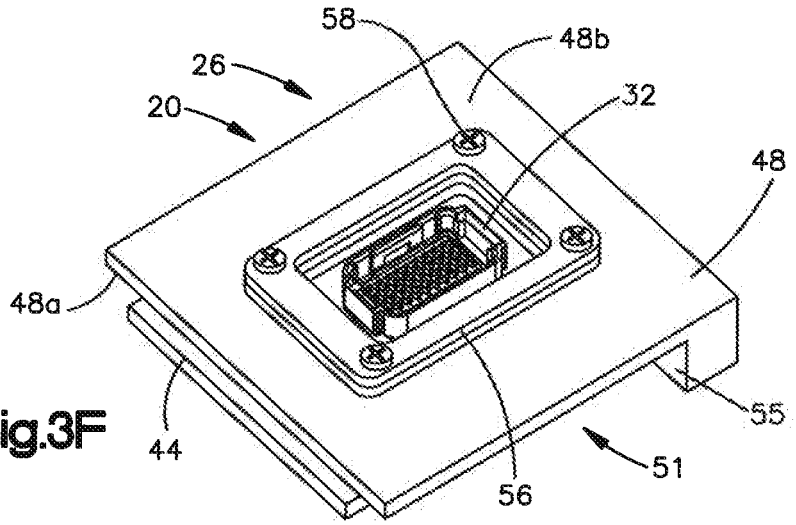
FIG. 3F is a perspective view of the assembly illustrated in FIG. 3D, showing the stiffener secured so as to produce the electrical connector assembly illustrated in FIG. 1.

The seal member 54 can be configured as an elastomeric gasket, or as any suitable alternatively constructed seal member 54, for instance as described herein, or any suitable alternative seal member that is suitable for hermetically sealing the substrate 28 and the case 48. As illustrated in FIGS. 3D-3F, once the interposer 22 and the first electrical subassembly 24 have been mated to each other, a stiffener member 56 can be applied to the second surface 28*b* of the substrate 28. For instance, the stiffener member 56 can capture the substrate 28 between the case 46 and the stiffener member 56. Accordingly, when the substrate 28 is configured as a flexible printed circuit, the stiffener member 56 can add rigidity and structural integrity to the substrate 28. The stiffener member 56 can surround the second electrical connector 32. For instance, the stiffener 56 can define an internal opening that receives the second electrical connector 32. The stiffener can further be aligned with at least a portion up to an entirety of the seal member 54 along a transverse direction. It should be appreciated that the electrical connectors 30 and 46 are mated to each other in the transverse direction. It should be further appreciated that the case 48 and the substrate 28 face each other along the transverse direction. The electrical connector assembly 20 can further include a plurality of fasteners 58 that can extend through the stiffener member 56 through the apertures 38 of the substrate 28, and into the case 48. The fasteners 58 can, for instance, threadedly mate to the case 48. Thus, the fasteners 58 can be tightened down such that the head of the fasteners 58 bear against the stiffener member 56, which in turn bears against the substrate 28. Because the fasteners 58 are further connected to the case 48, the fasteners 58 can be tightened so as to cause the stiffener 58 to compress the substrate 28 against the case 48, thereby compressing the seal member 54 against both the substrate 28 and the case 48 when the seal member 54 is configured as an elastomeric gasket.

Figure 6:
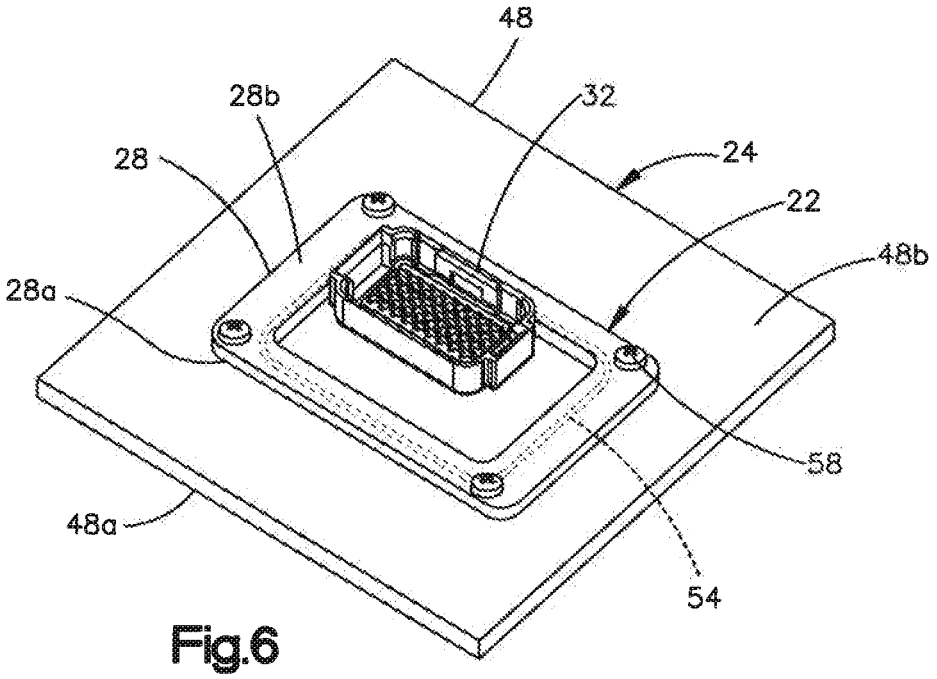
FIG. 6 is a perspective view of an electrical connector assembly, constructed in accordance with an alternative embodiment.

Referring now to FIG. 6, it should be appreciated that the substrate 28 can be configured as a printed circuit board as opposed to a flexible printed circuit. Thus, the substrate 28 can comprise FR4 material, which is a composite material composed of woven fiberglass cloth with an epoxy resin binder. Accordingly, the electrical connector assembly 20 can be devoid of the stiffener member 56. Alternatively, the fasteners 58 can extend through the substrate 28 and into the case 48. The fasteners 58 can, for instance, threadedly mate to the case 48. Thus, the fasteners 58 can be tightened down such that the heads of the fasteners 58 bear against the stiffener member 56, which in turn bears against the substrate 28. Because the fasteners 58 are further connected to the case 48, the fasteners 58 can be tightened so as to cause the stiffener 58 to compress the substrate 28 against the case 48, thereby compressing the seal member 54 against both the substrate 28 and the case 48 when the seal member 54 is configured as an elastomeric gasket.

Figure 7A:
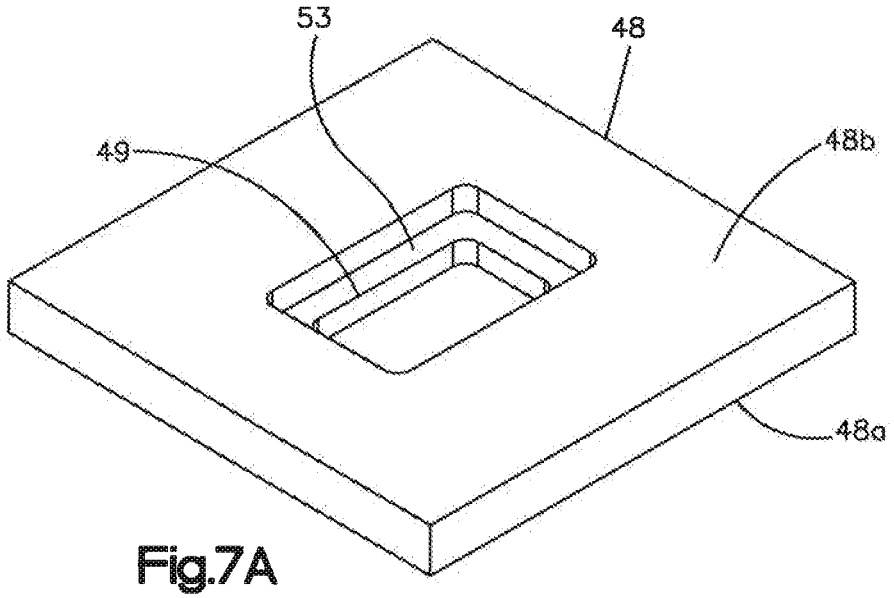
FIG. 7A is a perspective view of a hard disk drive case constructed in accordance with an alternative embodiment.
Figure 7B:
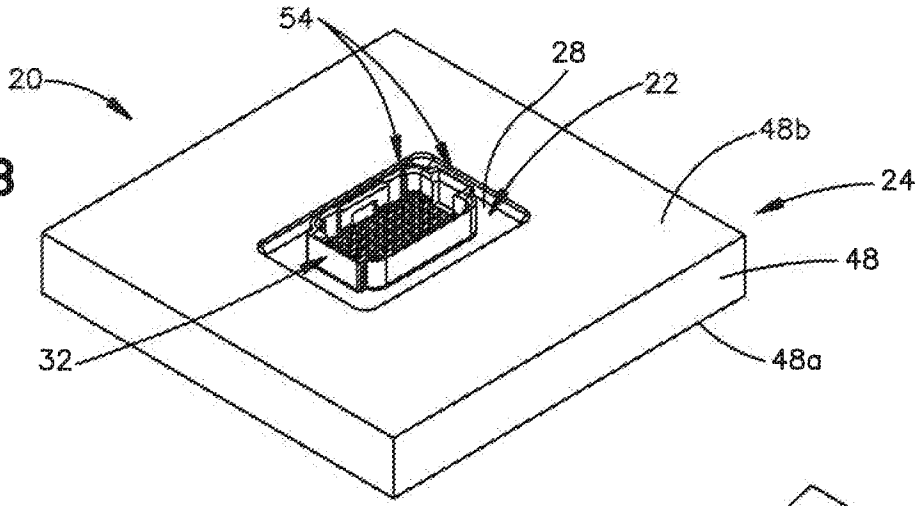
FIG. 7B is a perspective view of the hard disk drive case illustrated in FIG. 7A, shown attached to the interposer.
Figure 8B:
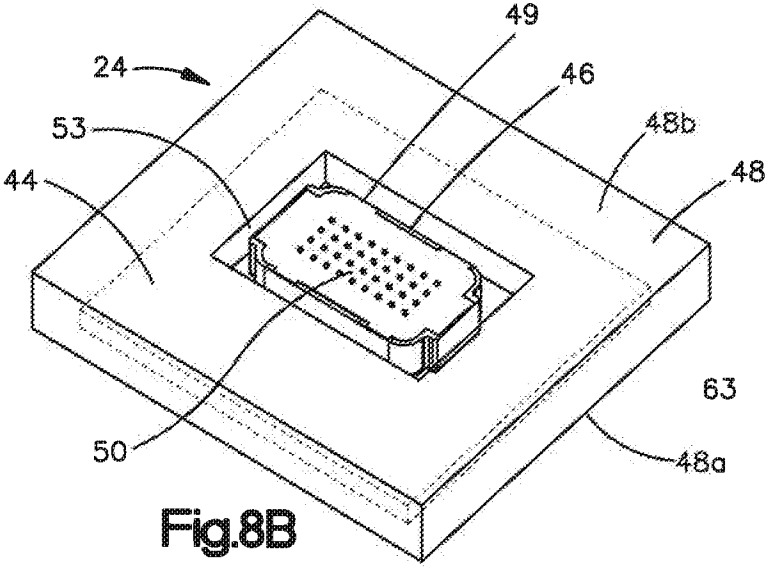
FIG. 8B is a perspective view of the PCB subassembly including a hard disk drive case.
Figure 8A:
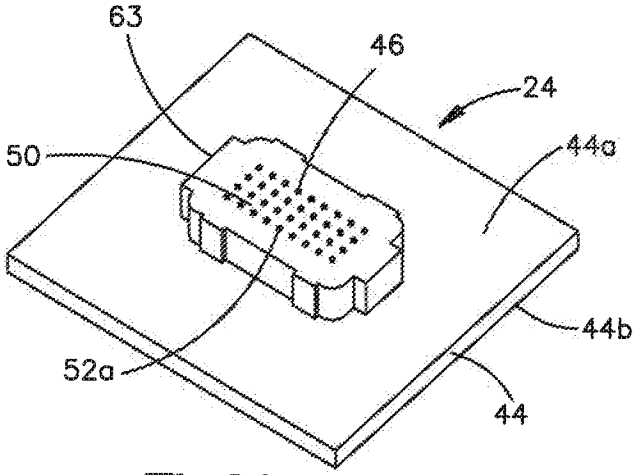
FIG. 8A is a perspective view of a substrate and an electrical connector of the PCB subassembly.
Figure 8C:
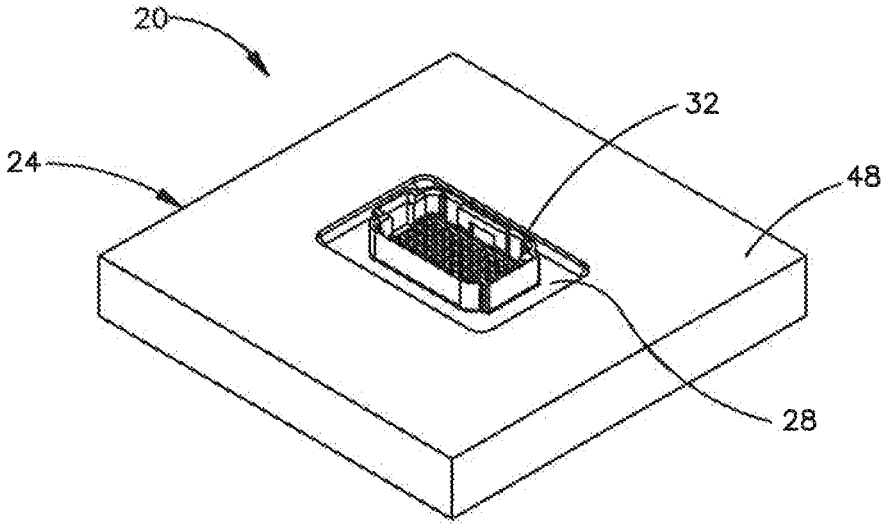
FIG. 8C is a perspective view showing the interposer mated with the PCB subassembly.
Figure 8D:
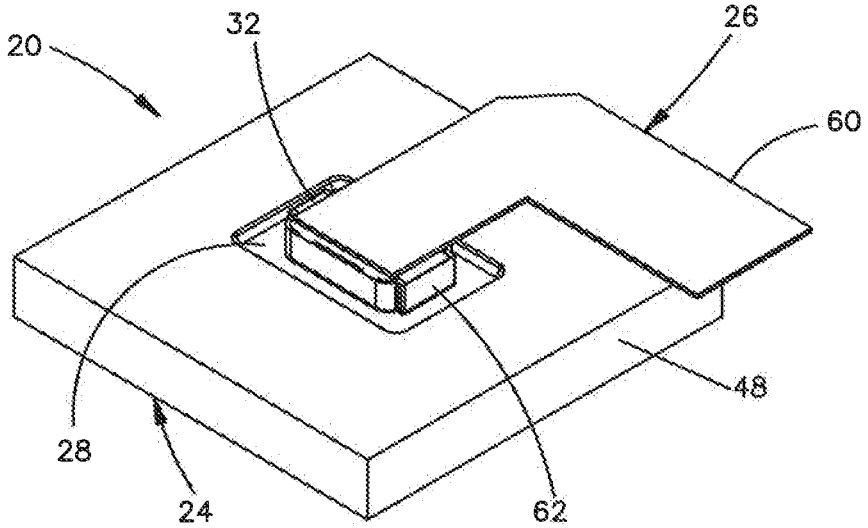
FIG. 8D is a perspective view showing the second subassembly mated to the interposer.

Alternatively, as illustrated in FIGS. 7A-7B, the seal member 54 can be configured as an epoxy sealant. The case 48 can define a recess 53 of the second surface 48*b* that extends toward the first surface 48*a* in the transverse direction, but not through to the first surface 48*a*. The recess 53 can be dimensioned so as to receive the substrate 28 of the interposer 22 when the first and third electrical connectors 30 and 46 are mated to each other. The recess can surround the aperture 49, and in some embodiments can define an outer perimeter of the aperture 49 at the second surface 48*b*. The epoxy sealant can be introduced in the recess 53 so cover the outer perimeter of the substrate 28 inside the recess 53. As a result, the epoxy sealant is present in sufficient quantity to secure the substrate 28 to the case 48 in the recess 53, and further to provide a hermetic seal at the interface between the substrate 28 and the case 48.

Figure 5A:
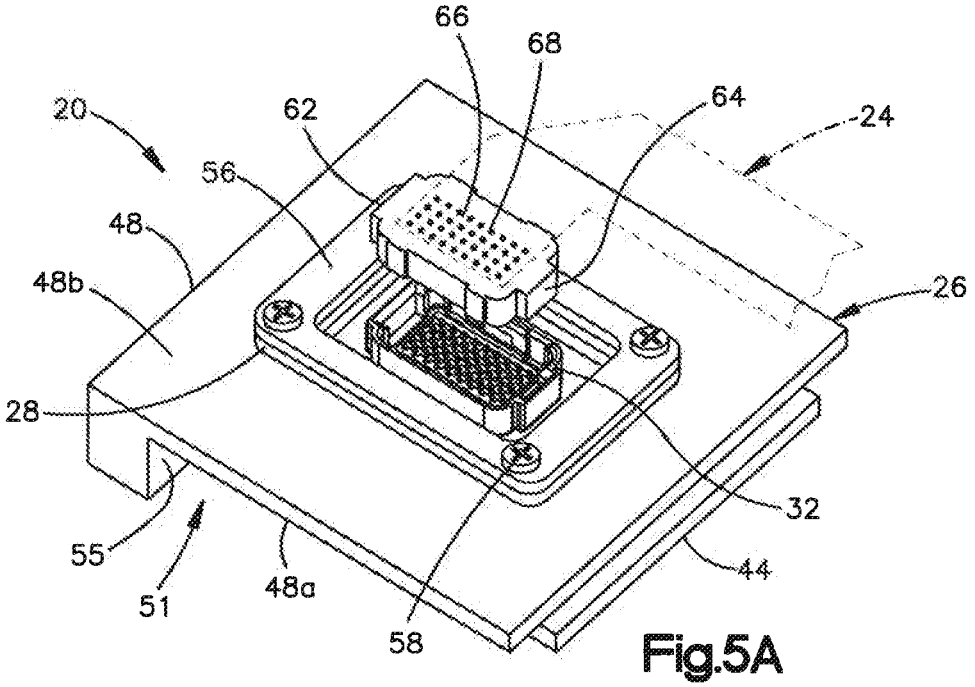
FIG. 5A is a perspective view showing a flex cable subassembly being mated to the interposer illustrated in FIG. 3F.
Figure 5B:
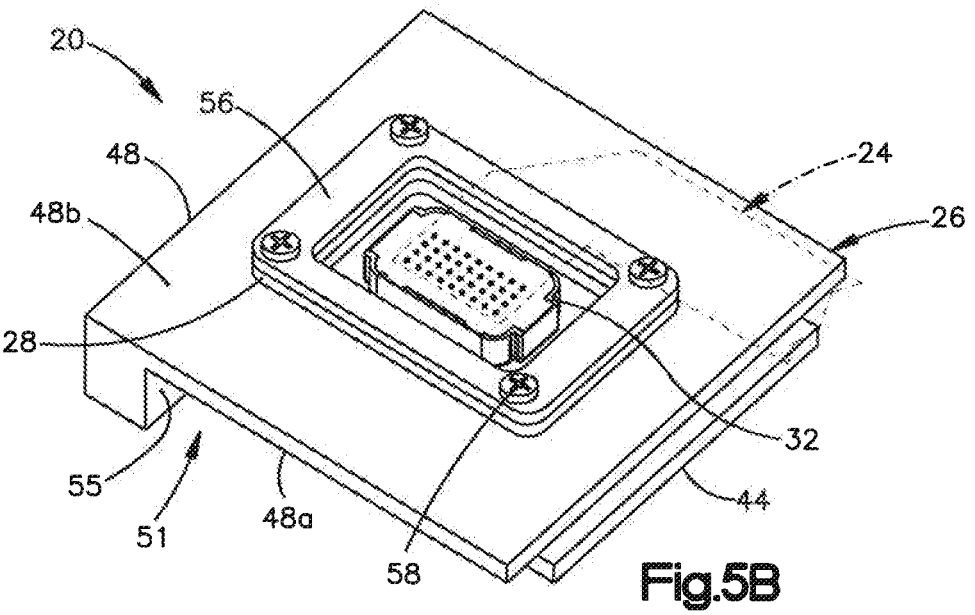
FIG. 5B is a perspective view showing a flex cable subassembly mated to the interposer as illustrated in FIG. 5A.

Referring now to FIGS. 5A-5B, the second electrical subassembly 26 is configured to mate with the second electrical connector 32, so as to be placed in electrical communication with the second electrical connector 32. Thus, the second electrical subassembly 26 is configured to mate with the second electrical connector 32, so as to be placed in electrical communication with the first electrical connector 30 through the second electrical connector 32. Accordingly, the first and second electrical subassemblies 24 and 26 are configured to be placed in electrical communication with each other through the interposer 22. The second electrical subassembly 26 includes a flat flex cable 60 that carries a plurality of electrical conductors, and a corresponding electrical connector 62 mounted to the flat flex cable 60, and thus in electrical communication with the electrical conductors of the flat flex cable 60. Thus, the second electrical subassembly 26 can be referred to as a flex cable subassembly. The electrical connector 62 of the second electrical subassembly 26 can be referred to as a fourth electrical connector.

The fourth electrical connector 62 is configured to mate with the second electrical connector 32. For instance, the fourth electrical connector 62 includes a connector housing 64, and a plurality of electrical contacts 66 that are supported by the connector housing 64. The connector housing 64 can be received by the connector housing 40 of the second electrical connector 32 when the second and fourth electrical connectors 32 and 62 are mated to each other. Alternatively, the connector housing 64 can receive the connector housing 40 of the second electrical connector 32 when the second and fourth electrical connectors 32 and 62 are mated to each other. The electrical connector 62 can include any number of rows and columns of electrical contacts 66 as desired. For instance, the fourth electrical connector 62 can include the same number of rows and columns as the second electrical connector 32, such that each of the electrical contacts 66 of the fourth electrical connector 62 are configured to mate with respective ones of the electrical contacts 50 of the second electrical connector 32. The electrical contacts 66 can be constructed generally as described in U.S. Pat. No. 6,042,389, or US Published Patent Application No. 2014/0017957, the disclosure of each of which is hereby incorporated by reference as if set forth in its entirety herein. The electrical contacts 66 can include signal contacts and ground contacts. Adjacent ones of the signal contacts can define differential signal pairs, and adjacent differential signal pairs can be separated by at least one ground contact. The differential signal pairs can be edge coupled or broadside coupled pairs as desired. The fourth electrical connector 62 can be constructed identical with respect to the third electrical connector 46, or differently as desired.

Figure 5C:
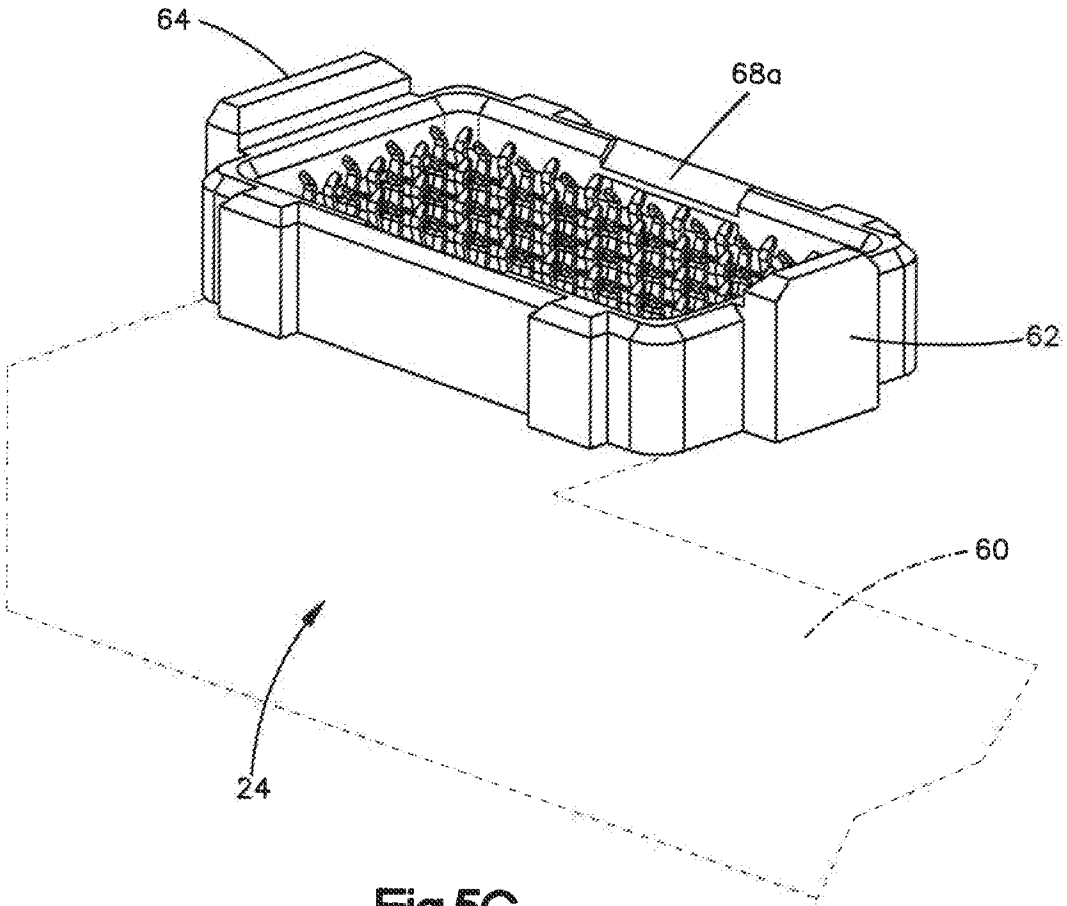
FIG. 5C is a perspective view showing a the flex cable subassembly of FIGS. 5A and 5B of the electrical contacts mating ends.

Each of the electrical contacts 66 can define a mating end 68*a* (FIG. 5C) and a mounting end 68*b*. The mounting ends 68*b* can be surface mounted to the flex cable 60 so as to be placed in electrical communication with the flex cable 60. The electrical contacts 66 can be referred to as surface mount contacts, and the fourth electrical connector 62 can be referred to as a surface mount connector. For instance, the electrical contacts 66 can support a fusible element, such as a solder ball, at the mounting ends 68*b*. The solder balls can all be co-planar with each other both before and after the solder reflow process is completed that bonds the fusible elements to respective contact pads of the flex cable 60, thereby mounting the fourth electrical connector 62 to the flex cable 60. The solder balls can be mounted to the contact pads by positioning the first fourth electrical connector 62 on contact pads of the flex cable 60, and subjecting the fourth electrical connector 62 and the flex cable 60 to a solder reflow process whereby the solder balls fuse to the contact pads of the flex cable 60. The solder balls can be integral and monolithic with the electrical contacts 66, or can be separate and attached to the mounting ends 68*b*. Alternatively, the mounting ends 68*b* can be configured as J-shaped leads that are compressed against the contact pads so as to mount the fourth electrical connector 62 to the flex cable 60. Alternatively still, the mounting ends 68*b* can be configured as press-fit tails that are inserted into the outer electrically insulative material flex cable 60 and connected to the electrical conductors carried in the electrically insulative material.

The mating ends 68*a* can be configured as receptacle mating ends that are configured to receive the plug mating ends 42*a* of the second electrical connector 32 so as to mate the second and fourth electrical connectors 32 and 62 to each other. Alternatively, the mating ends 68*a* can be configured as plug mating ends that are configured to be received by the mating ends 42 of the second electrical connector 32, which can be configured as receptacle mating ends. Alternatively still, the mating ends 42*a* and 68*a* can both be configured as receptacle beams that are configured to mate with each other. In one example, the mating ends 68*a* and the mounting ends 68*b* are oriented parallel to each other, such that the electrical contacts 66 can be referred to as vertical contacts. In another embodiment, the mating ends 68*a* and the mounting ends 68*b* can be oriented perpendicular to each other, such that the electrical contacts 66 can be referred to as right-angle contacts.

It should be appreciated that when each of the first and second electrical subassemblies 24 are each mated to the interposer 22, the flex cable 60 is placed in electrical communication with the hard disk drives that are in electrical communication with the substrate 44. Further, when each of the first and second electrical subassemblies 24 are each mated to the interposer 22, the electrical connector assembly 20 can define any distance along the transverse direction from the first surface 28*a* of the substrate 28 to the first surface 44*a* of the substrate 44 of the first electrical subassembly 24. The distance can be any distance as desired, for instance between and including 3 mm and 8 mm, including between 3 mm and 5 mm, including approximately 4 mm. The total stack height of the electrical connector assembly 20 can be the thickness of the substrate 28 of the interposer in addition to two times the combined mated height of the electrical connectors 30 and 46, and 32 and 62. The combined mated height of the electrical connectors 30 and 46, and 32 and 62 can range from 4 mm and above.

Referring now to FIGS. 8A-8D, it should be appreciated that the seal member 54 can be configured as a fusible material. The fusible material can be a solder material or a weldable material. For instance, the solderable material can be a metallic material. The weldable material can be a metallic material or a thermoplastic as desired. In one embodiment, the metallic material is copper. It should be appreciated, of course, that the metallic material can be any suitable alternative material as desired. In accordance with one embodiment, the seal member 54 can be supported by the first surface 28*a* of the substrate 28 of the interposer 22 in the manner described above. Thus, the seal member 54 can at least partially surround the electrical contact pads 34, and the corresponding vias 36. For instance, the seal member 54 can completely circumscribe the electrical contact pads 34, and the corresponding vias 36. The seal member 54 can be supported by the first surface 28*a* of the substrate prior to mating the first electrical connector 30 with the third electrical connector 46. Accordingly, the seal member 54 can be fused, for instance soldered or welded, to the second surface 48*b* of the case after the first electrical connector 30 has been mated with the third electrical connector 46. Alternatively, the seal member 54 can be supported by the second surface 48*b* of the case 48 prior to mating the first electrical connector 30 with the third electrical connector 46. Accordingly, the seal member 54 can be fused, for instance soldered or welded, to the first surface 28*a* of the substrate 28 after the first electrical connector 30 has been mated with the third electrical connector 46. Alternatively, the seal member 54 can be disposed between the second surface 48*b* of the case 48 and the first surface 28*a* of the substrate 28 prior to mating the first electrical connector 30 with the third electrical connector 46. Accordingly, the seal member 54 can be fused, for instance soldered or welded, to both the first surface 28*a* of the substrate 28 and the second surface 48*b* of the case 48 after the first electrical connector 30 has been mated with the third electrical connector 46. The substrate 28 can reside in a recess of the type described above with respect to recess 53. Alternatively, the portion of the second surface 48*b* that surrounds the aperture 49 can be substantially planar with a remaining portion of the second surface 48*b*, or can be raised with respect to the remaining portion of the second surface 48*b*. Once the seal member 54 fused the substrate 28 to the case 48, the second electrical subassembly 26 can be mated to the second electrical connector 32 in the manner described above. Alternatively, reducing the assembly could be achieved by eliminating connectors 32 and 62 and directly attach flex circuit 60 with solder balls to the polyimide or LCB board 28. In that design there would be a mated set of connectors inside the drive and just a flex circuit attached to board 28 on the outside.

Figure 9:
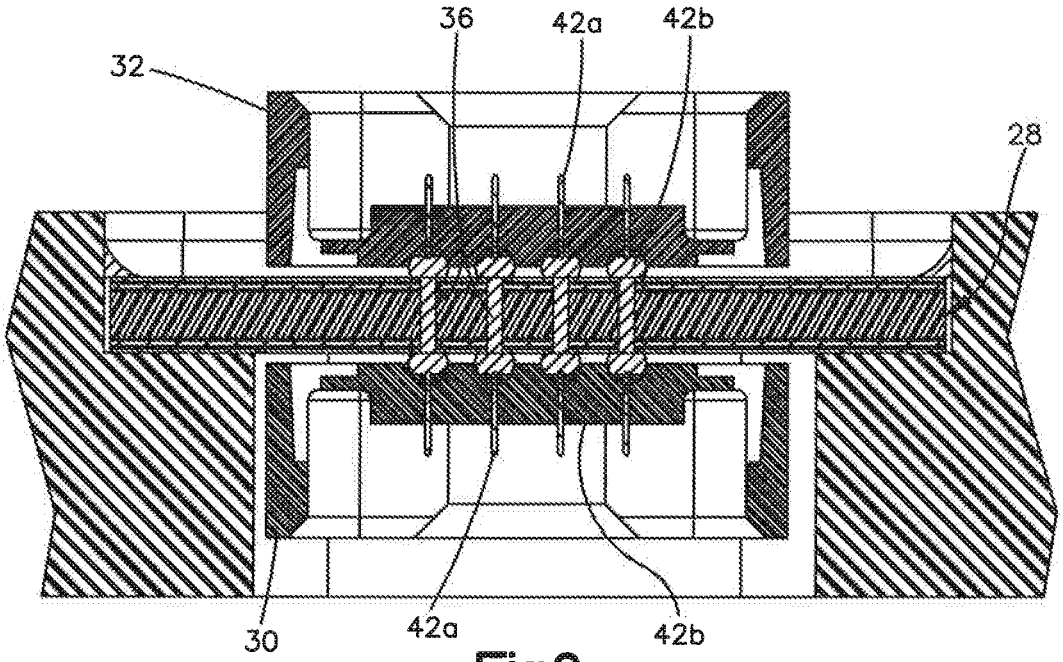
FIG. 9 is an alternate embodiment of the interposer mounted to the PCB subassembly.

Referring now to FIG. 9, an alternate embodiment of interposer 22 is shown. As described above, substrate 28 can include electrically conductive vias establishing electrical communication between the first surface 28*a* and the second surface 28*b*. It was also described that vias 36 can be plated with an electrically conductive material filled with an electrically conductive material. It was further described that the first and second electrical connectors 30 and 32 can include a plurality of electrical contacts 42 defining a mating end 42*a* and a mounting end 42*b*. The electrical contacts 42 were further described as supporting a fusible element, such as a solder ball, at the mounting ends 42*b*. With such a structure electrical connectors 30 and 32 can be attached to substrate 28 by any desireable solder reflow process that bonds the fusible elements. As shown in FIG. 9, solder balls 70 are positioned proximate the via openings such that during the reflow process the solder balls also flow to fill the vias formed in substrate 28.

Figure 10A:
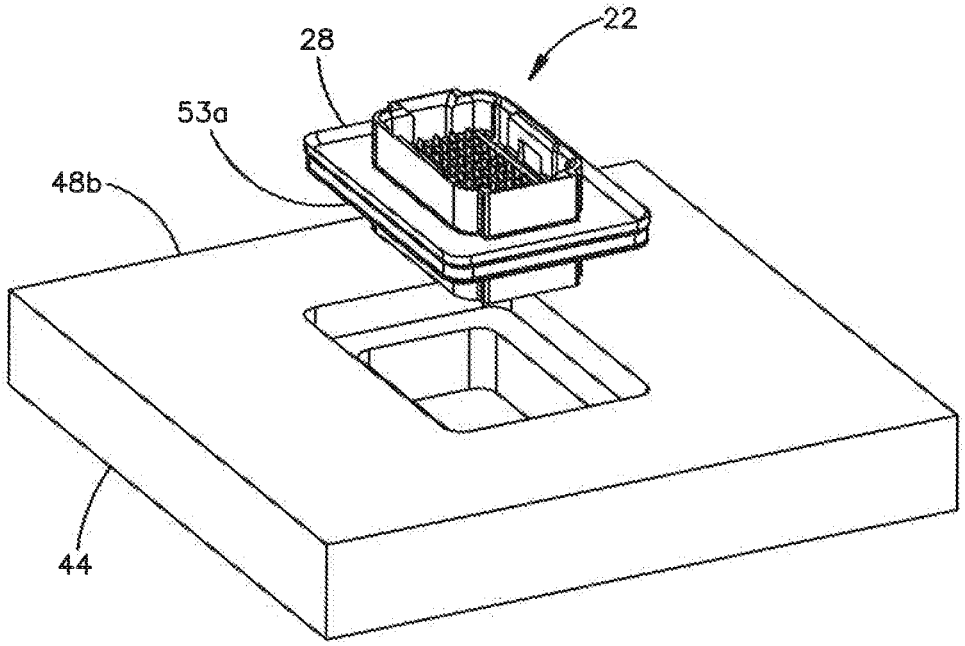
FIG. 10A is a perspective view of an alternate embodiment of the interposer before mounting to the PCB subassembly.
Figure 10B:
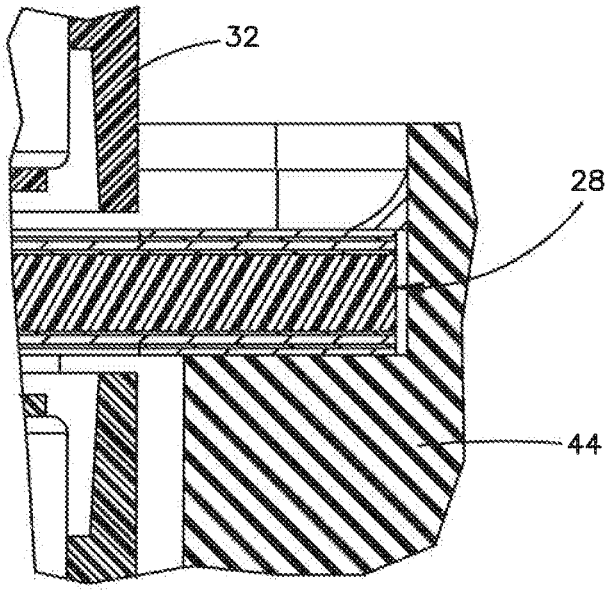
FIG. 10B is an enlarged view of the interposer disclosed in FIG. 10A mounted onto the PCB subassembly.

As was described above in relation to FIGS. 7A-7B, the seal member 54 was alternatively an epoxy sealant. Referring now to FIG. 10*a*-10*b*, a further alternative is disclosed for joining interposer 22 to case 44 in a manner to maintain a hermetic seal. In this embodiment, case 48 can define a further inner recess 53*a* formed in recess 53 of the second surface 48*b* that extends toward the first surface 48*a* in the transverse direction. The recess 53*a* is dimensioned so as to receive the substrate 28 of the interposer 22. In this embodiment, interposer 22 is soldered to case 44. The process for soldering interposer 22 to case 44 includes chemically cleaning surfaces that will be joined. Stenciling tinning paste onto the cleaned surface and reflowing the tinning paste using any suitable process, such as induction soldering coil. Next, the tinned area that will be soldered is chemically cleaned. Solder paste is stenciled onto the cleaned surface in any preferred pattern. Interposer 22 is then placed onto the solder paste. The solder paste is then reflowed using any desirable method such as an induction soldering coil.

Figure 11:
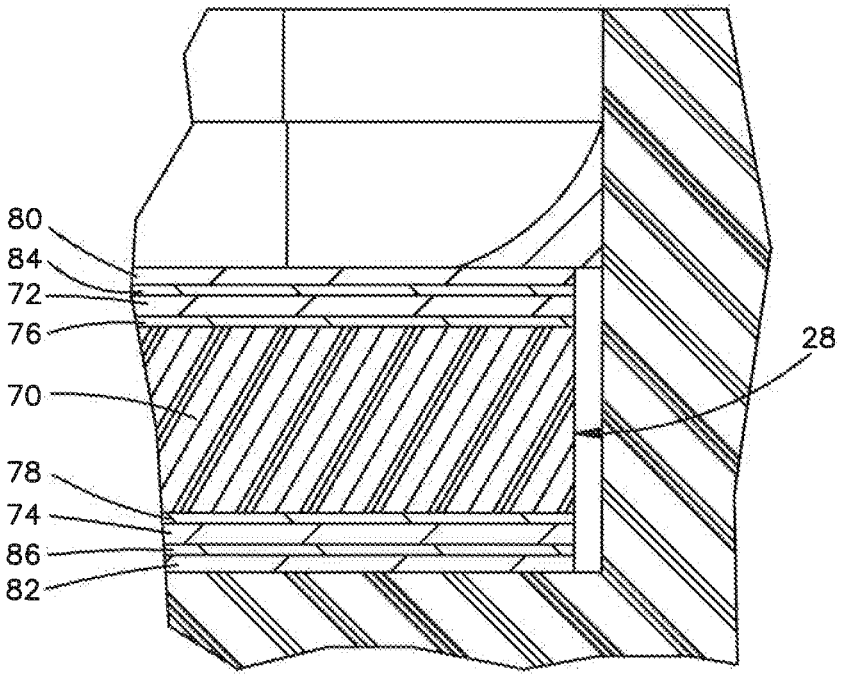
FIG. 11 is an enlarged view of a portion of the interposer disclosed in FIG. 10B.

In an especially preferred embodiment, substrate 28 is clad with a metal such as copper. Referring to FIG. 11, substrate 28 includes a layer 70 of bonded filament woven fiberglass sheets such as FR4 material. Substrate 28 further includes first and second layers 72 and 74 of polymer film attached to layer 70 by respective adhesive layers 76 and 78. Thus, the substrate 28 can be referred to as a laminate structure, having a layer of FR4 material disposed between adjacent layers of polymer film. It should also be appreciated that the substrate 28 can include as many interleaved layers of FR4 material and polyimide material as desired.

Still further, layers 80 and 82 of a metal such as copper is attached by interposed layers of adhesive 84 and 86. It is especially preferred for layers 80 and 82 to be plated. Again, the FR4 material can be gas impermeable. For instance, the FR4 material can be hydrogen or helium impermeable.

Figure 12A:
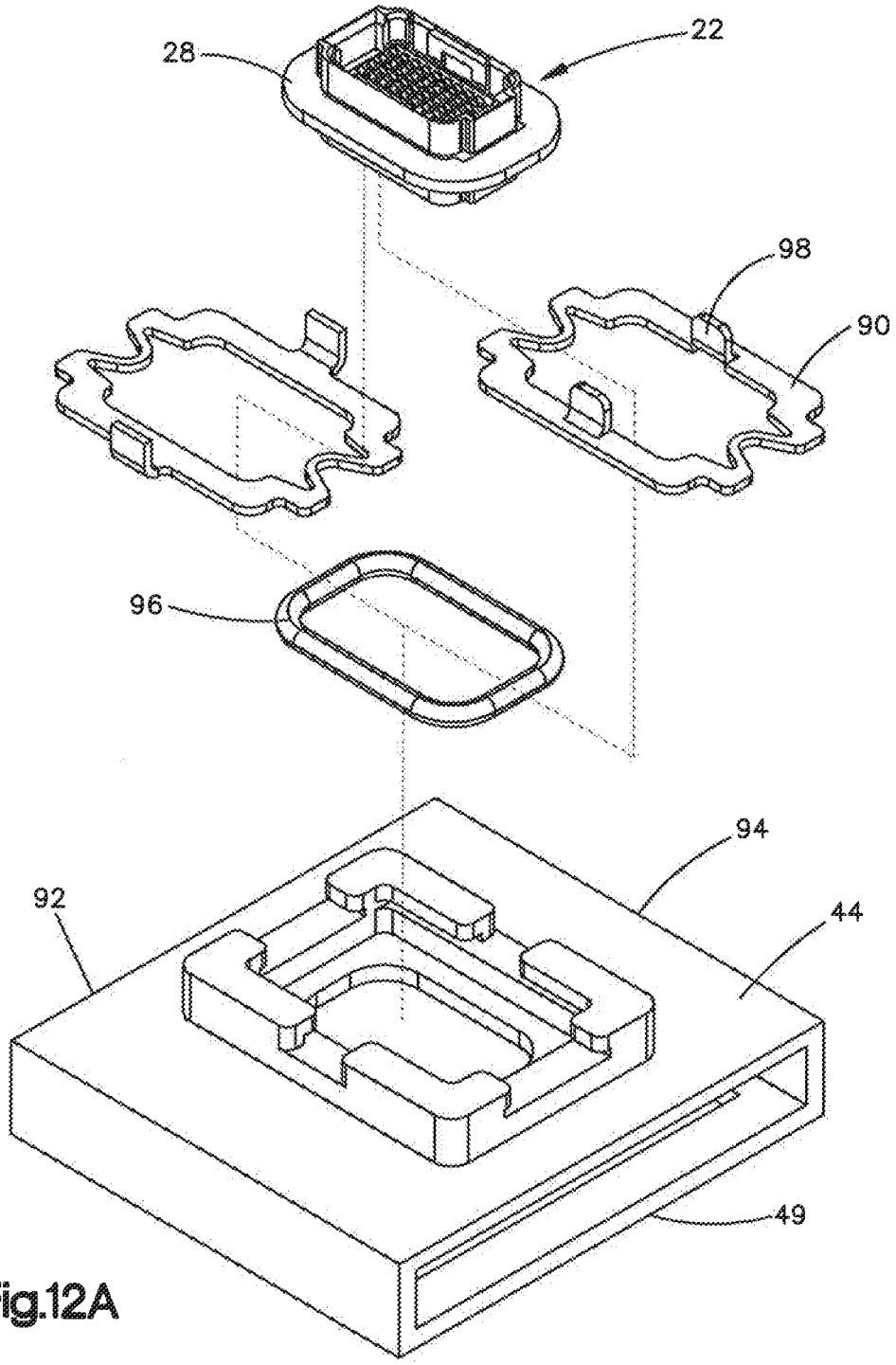
FIG. 12A is an exploded perspective view of an alternate embodiment of the interposer before mounting to the PCB subassembly.
Figure 12B:
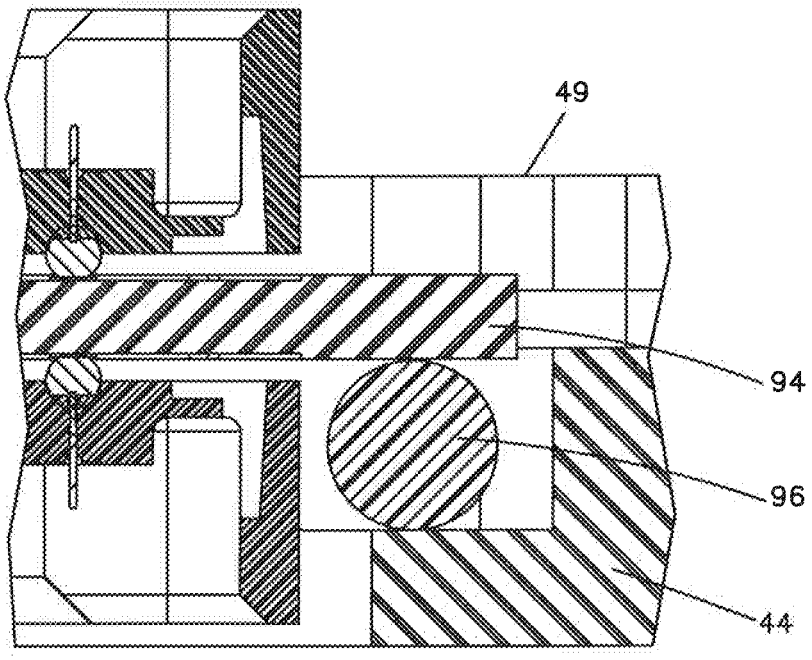
FIG. 12B is an enlarged view of the interposer of FIG. 12A before final mounting to the PCB subassembly.
Figure 12C:
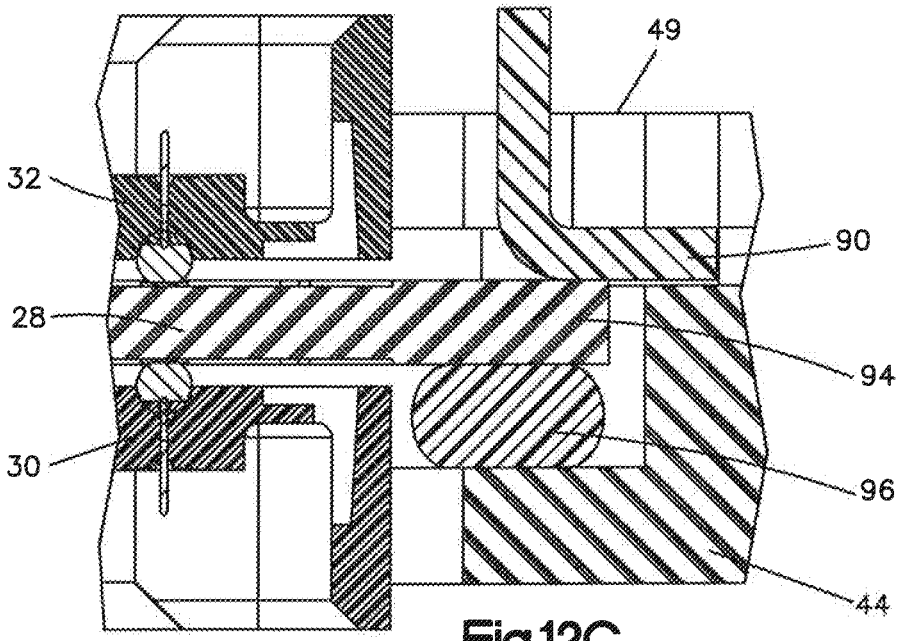
FIG. 12C is an enlarged view of e interposer of FIG. 12A after mounting to the PCB subassembly.

Referring now to FIGS. 12*a*-12*c*, a still further embodiment is disclosed for attaching interposer 22 to casing 44 resulting in a hermetic seal. In this embodiment a spring clip 90 is used to attach interposer 22 to casing 44. As shown, casing 44 includes a raised region 92 surrounding opening 49. A channel 94 is formed in region 92 on either side of opening 49. An o-ring 96, formed from any suitable material, is placed into case 44. Interposer 22 is then placed onto o-ring 96. Pressure is applied to interposer 22, thereby compressing o-ring 96 (FIG. 12*c*). Spring clip 90 is then squeezed together using tabs 98 and placed onto interposer 22. Spring clip 90 is released permitting expansion of the clip into slots 94 in case 44. Compression is then removed from interposer 22, thereby locking clip 90 and o-ring 96 into case 44 and creating a hermetic seal.

The embodiments described in connection with the illustrated embodiments have been presented by way of illustration, and the present invention is therefore not intended to be limited to the disclosed embodiments. Furthermore, the structure and features of each the embodiments described above can be applied to the other embodiments described herein, unless otherwise indicated. Accordingly, those skilled in the art will realize that the invention is intended to encompass all modifications and alternative arrangements included within the spirit and scope of the invention, for instance as set forth by the appended claims.

What is claimed:

1. An interposer comprising:

a substrate that defines a first surface and a second surface opposite the first surface, electrical contact pads on each of the first and second surfaces, and vias that each extend through the substrate and electrically connect the electrical contact pads on the first surface with respective electrical contact pads on the second surface;

a seal member that at least partially surrounds the electrical contact pads on the first surface, and is configured to hermetically seal an interface between the first surface and a hard disk drive case of an electrical subassembly when the electrical subassembly is mated to the interposer; and a surface mount connector mounted to the first surface via solder balls, wherein a portion of said solder balls has flowed into said vias.

2. The interposer as recited in claim 1, wherein the seal member comprises an elastomeric gasket.

3. The interposer as recited in claim 1, wherein the seal member comprises an epoxy.

4. The interposer as recited in claim 1, wherein the seal member is a fusible material that partially surrounds the electrical contact pads on the first opposed surface.

5. The interposer as recited in claim 4, wherein the fusible material completely circumscribes the electrical contact pads on the first opposed surface.

6. The interposer as recited in claim4, wherein the fusible material is a solderable material.

7. The interposer as recited in claim 4, wherein the fusible material is a weldable material.

8. The interposer as recited in claim 4, wherein the fusible material comprises copper.

9. The interposer as recited in claim 1, wherein the substrate is flexible.

10. The interposer as recited in claim 9, wherein the substrate comprises a gas-impermeable polyimide material.

11. The interposer as recited in claim 10, wherein the substrate comprises first and second layers of gas-impermeable polyimide material, and at least one layer of FR4 material disposed between the first and second layers of gas-impermeable polyimide material.

12. An electrical connector assembly comprising:

1) an interposer that includes:

a) a substrate that defines a first surface and a second surface opposite the first surface, electrical contact pads on each of the first and second surfaces, and vias that each extend through the substrate and electrically connect the electrical contact pads on the first surface with respective electrical contact pads on the second surface;

b) a first electrical connector that is surface mounted to the contact pads of the first surface; and c) a second electrical connector that is surface mounted to the contact pads of the second surface; and 2) a first electrical subassembly that includes:

a) a printed circuit board that defines a first surface and a second surface opposite the first surface;

b) a third electrical connector that is surface mounted to the first surface of the printed circuit board; and c) a hard disk drive case that defines a first surface and a second surface opposite the first surface, wherein the first surface defines an interior, wherein the third electrical connector is configured to mate with the first electrical connector, and the electrical connector assembly further comprises a seal member configured to hermetically seal the substrate to the hard disk drive case.

13. The electrical connector assembly as recited in claim 12, wherein the seal member is a fusible material that partially surrounds the electrical contact pads on the first opposed surface.

14. The electrical connector assembly as recited in claim 13, wherein the fusible material comprises copper.

15. The electrical connector assembly as recited in claim 12, wherein the hard disk drive case defines an aperture that extends from the first surface to the second surface, the aperture sized to receive the first electrical connector.

16. The electrical connector assembly as recited in claim 15, wherein first surface of the hard disk drive case faces the printed circuit board, and the hard disk drive case defines a recess that extends into the second surface toward the first surface, the recess defining a perimeter of the aperture, and the recess is sized to receive the substrate.

17. The electrical connector assembly as recited in claim 16, wherein the recess receives the seal member.

18. The electrical connector assembly as recited in claim 17, further comprising a plurality of fasteners that compress the substrate against the hard disk drive case.

19. The electrical connector assembly as recited in claim 18, wherein the seal member comprises an elastomeric gasket disposed at an interface of the substrate and the hard disk drive case.

20. The electrical connector assembly as recited in claim 19 wherein the first surface of the substrate is coated with a metal.

21. The electrical connector assembly as recited in claim 20, wherein the metal is silver.

22. An electrical connector assembly, comprising:

an interposer that comprises a substrate that defines a first surface and a second surface opposite the first surface, electrical contact pads on each of the first and second surfaces, and vias that each extend through the substrate and electrically connect the electrical contact pads on the first surface with respective electrical contact pads on the second surface;

a first electrical connector that is surface mounted to the contact pads of the first surface via solder balls, wherein a portion of the solder balls has flowed into the vias; and a second electrical connector that is surface mounted to the contact pads of the second surface.

23. An electrical connector assembly, comprising:

an interposer that comprises a substrate that defines a first surface and a second surface opposite the first surface, electrical contact pads on each of the first and second surfaces, and vias that each extend through the substrate and electrically connect the electrical contact pads on the first surface with respective electrical contact pads on the second surface;

a first electrical connector that is surface mounted to the contact pads of the first surface;

a second electrical connector that is surface mounted to the contact pads of the second surface and has a plurality of mating ends; and a third electrical connector having a plurality of mating ends configured to mate to the plurality of mating ends in the second electrical connector.

24. The electrical connector assembly of claim 23, further comprising a flat flex cable, wherein the third electrical connector is mounted to the flat flex cable and configured to mate to the second electrical connector so as to place the flat flex cable in electrical communication with the first electrical connector.

25. The electrical connector assembly of claim 23, further comprising a seal member that at least partially surrounds the electrical contact pads on the first surface.

26. The electrical connector assembly of claim 25, in combination with a case, wherein the seal member is configured to hermetically seal the substrate to the case.

27. The electrical connector assembly of claim 26, wherein the case comprises an aperture sized to receive the first electrical connector.

* * * * *